US005743665A

United States Patent [19]

Ryan et al.

[11] Patent Number: 5,743,665

[45] Date of Patent: Apr. 28, 1998

[54] PRINTER INTEGRATED DRIVER AND HAMMERBANK

[75] Inventors: Robert P. Ryan, Mission Viejo; Gordon Barrus, Paseo Christina, both of Calif.

[73] Assignee: Printronix, Inc., Irvine, Calif.

[21] Appl. No.: 807,575

[22] Filed: Feb. 27, 1997

Related U.S. Application Data

[63] Continuation of Ser. No. 404,723, Mar. 15, 1995, abandoned.

[51] Int. Cl.[6] ..... B41J 2/235

[52] U.S. Cl. ..... 400/323; 400/157.2; 101/93.29

[58] Field of Search ..... 101/93.03, 93.04, 101/93.05, 93.29; 400/157.2, 157.3, 166, 320, 322, 323, 174, 175

[56] References Cited

U.S. PATENT DOCUMENTS 3,941,051 3/1976 Barrus et al. ..... 101/93.04

4,359,289 11/1982 Barrus et al. ..... 400/322

4,875,409 10/1989 Condon et al. ..... 101/93.29

5,361,693 11/1994 Farb et al. ..... 101/93.04

FOREIGN PATENT DOCUMENTS 61-242856 A 10/1986 Japan ..... 400/157.2

*Primary Examiner*—Edgar S. Burr

*Assistant Examiner*—Steven S. Kelley

*Attorney, Agent, or Firm*—George F. Bethel; Patience K. Bethel

[57] ABSTRACT

A printer with a reciprocally moving hammerbank with a plurality of hammers thereon is disclosed including a magnet for retaining hammers on the hammerbank of the printer from a firing position. A coil overcomes the magnetism of the magnet by a circuit for reversing the magnetic field. At least a portion of the circuit comprises transistor drivers located directly on the hammerbank of the printer.

21 Claims, 5 Drawing Sheets

PRINTER INTEGRATED DRIVER AND HAMMERBANK

This application is a continuation of Ser. No. 08/404,723 filed on Mar. 15, 1995, now abandoned.

BACKGROUND OF THE INVENTION

1. Field of the Invention

The field of this invention is within the printer art. More particularly, it resides within the printer art as it relates to impact printers in which a ribbon is impacted against an underlying piece of print media. More particularly, it can be described as relating to impact printers in the form of line printers or those types of printers that rely upon a series of hammers that are released for printing against an underlying print media.

2. Description of the Prior Art

The prior art with regard to impact printers is such wherein it is known that impact printers can provide high rates of printing in adverse environments. This is due to the fact that impact printers specifically rely upon impacting at high rates a ribbon against an underlying piece of print media. The impacting of the ribbon against the underlying piece of print media allows for adverse environmental situations to be accounted for due to the rugged nature of such impact printers.

The impact printers of the type which are impacted by a hammer from a hammerbank or other hammer sources can operate over extended periods of time in many rugged environments. The impact printers rely upon a dot matrix configuration to create alpha numeric or other print forms, such as bar codes. During the impacting of a ribbon against underlying print media, it is known to create substantial densities of dots for a dot matrix formation.

The creation of dots to form a dot matrix for various high density applications such as bar code printing creates a substantial load on the printer. This being the case, it has been found that the impact printers of the prior art would sometimes fail due to such heavy density and loading of the printer.

One particular application of heavy density printing is with line printers. Such line printers employ a series of hammers in what is known as a hammerbank. The hammers can vary in number depending upon the relative degree of speed with which printing is to take place. It can be appreciated that the greater number of hammers on a hammerbank will create high density faster printing because of an increased number of impacts that can be accommodated by the increased numbers of hammers. To this extent, it has been found that a hammerbank which can have a more finite application of the firing of the hammers is a distinct advantage over the prior art.

One of the efforts in the development of the art has always been to increase the speed of printing. Obviously, with the higher efficiency of increased speed of printing, the relative rate goes up and the productivity increases proportionately. In order to achieve these higher rates of printing, efforts have been made to speed up the movement of the hammerbank and the associated components which move the paper and interface the various interlocks for creating the printing that is necessary in a line printer.

During the process of increasing the rate of printing and making a more finite and discrete dot forming a dot matrix in the right place, it has been found that the less power that is required for releasing a hammer, the more discrete the placement of the dot can be. This is true particularly in light of the fact that it takes less circuitry to maintain placement of the dots if less power is required to cause a release of the hammer which impacts the ribbon to create a dot during the printing process.

One of the major power requirements in the entire printing process is the power required by the coils which release the hammers. Such coils are used to overcome the permanent magnetism retaining the hammers. When the permanent magnetism retaining the hammers is overcome, by the coils receiving power, the hammers then fire. The hammers are released predicated upon the negation of the magnetic field holding the hammers.

The less power required for the coils to overcome the permanent magnetism, the more discrete the action can be in allowing the hammers to fire at particular points along the entire series of dots forming the dot matrix printed by a line printer.

The prior art has relied upon providing the power to the coils from distinctly remote locations from the hammerbank. This is due to the fact that it was easier to place the transistors or the drivers at a remote location from the hammerbank. This involved an extremely long and circuitous route of a flex cable to the hammerbank from a substantially remote location to provide the drive to each respective coil.

The inventors have eliminated this long circuitous route of the power provided to the drivers to a flex cable by mounting the drivers in great measure on the hammerbank. In order to do this, they have relied upon the unique characteristics of their invention to emplace the drivers in the most efficacious manner on the hammerbank. At the same time the invention can accommodate power being supplied in part from the main portion of the controller board of the printer. This is accomplished by creating a plurality of drivers that control the low side of the coils of the hammerbank through transistors. Also, certain conditioning circuitry and the aspects of creating a logic function on the hammerbank is incorporated by the inventors. In many circumstances it is preferable to provide the drivers in their entirety on the integrated driver board of this invention.

Another consideration is that larger hammer counts or numbers of hammers are not practical with prior art cables due to the large number of interconnects. This invention solves the associated problem and provides for a larger number of hammers.

Another factor to be considered is the reduction of interconnect resistance. A given interconnect area must be divided into conductor area and insulation area. The reduced conductor count of this invention over the prior art, for example 19 as opposed to 196 for an 88 hammer system, greatly reduces wasted insulation space.

A significant factor for improving hammer current resolution is also provided. For instance, prior art cables had a significantly higher resistance over their length. Therefor, hammers at the far end of the hammerbank operated with higher series resistance and hence slower operating characteristics. The invention hereof incorporating the driver board in whole or in part mounted to the hammerbank contains uniform power planes allowing the hammers to operate with similar and lower series resistance characteristics.

The net result is to create a substantially lower impedance for the drivers of the hammerbank. This in turn reduces the amount of power required to fire the hammers. In reducing the amount of power, a more discrete control and finite ability to fire the hammers is accomplished. In allowing the hammers to fire in a more discrete manner, more finite printing in the form of a dot at a particular dot position in the matrix is accomplished. The net result is to create more finite printing through less power requirements increasing both quality of print and overall productivity as to the rate of printing. As a consequence, it is believed that this invention is a significant step over the art insofar as it relates to impact printing and more particularly printing from hammers within a hammerbank.

SUMMARY OF THE INVENTION

In summation, this invention comprises a line printer having a series of hammers in a hammerbank which are driven by the drivers on the hammerbank.

More particularly, the invention comprises an impact printer of the line printer type. The impact printer of the line printer type has a series of hammers that are connected to a hammerbank. Each hammer is retained by a permanent magnet and released by overcoming the permanent magnetism through an associated coil reversing the magnetic field.

In order to reverse the magnetic field, the coils are driven by a driver which resides on the hammerbank. Conditioning circuitry is also on the hammerbank along with an applications specific integrated circuit (ASIC) to control the firing in part.

The mounting of the drivers on the hammerbank allows considerable decreases in the energy required. This is due to the fact that the difference in ohms between the prior art and the invention hereof substantially reduces the power consumption. By reduction of the power, the invention allows for more discrete printing at locations of the dots of the dot matrix. The efficiency of the printer is increased as well as the quality and rate of production.

All of the foregoing elements of enhanced operation of this invention are substantially derived from the mounting of the drivers on the hammerbank and the decrease of overall power consumption. As a consequence the inherent nature of the invention in overcoming the relatively larger power requirements of the prior art and complexity with regard to flex cable mountings has enabled this invention to significantly improve impact printing for a dot matrix line printer.

DESCRIPTION OF THE PREFERRED EMBODIMENTS

Figure 1:
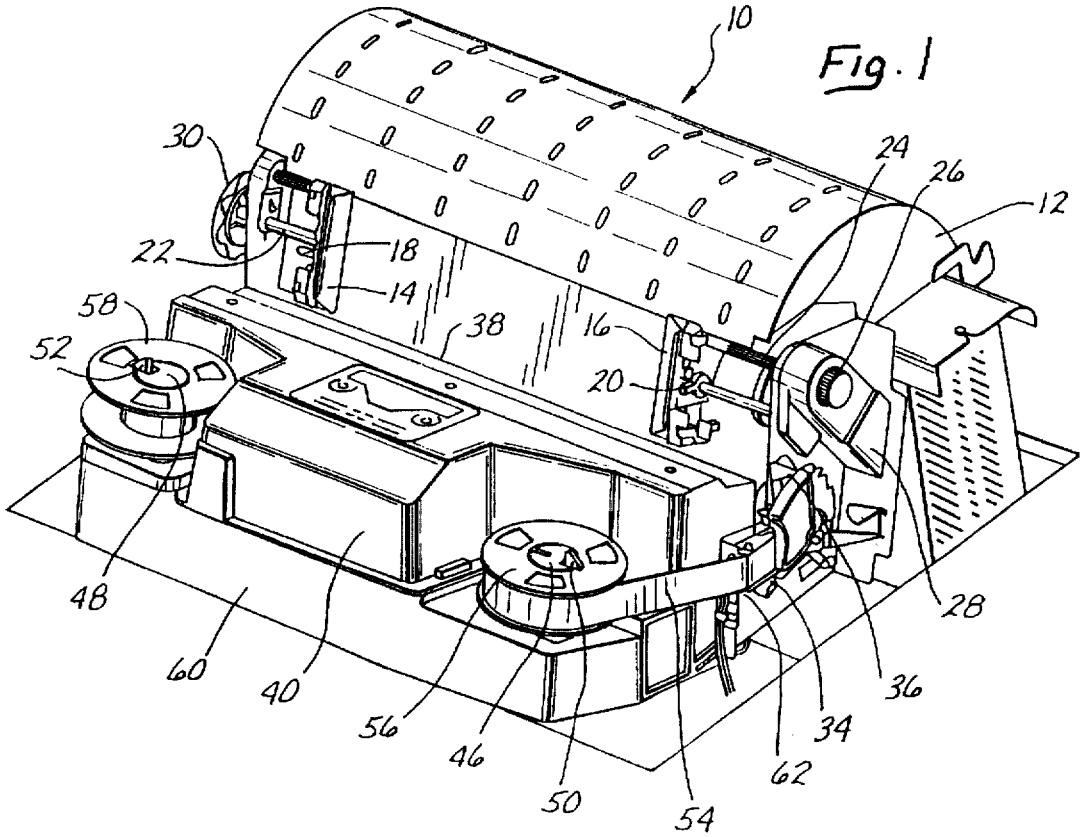
FIG. 1 shows a perspective view of the major portions of the dot matrix printer of this invention with certain portions exposed.

Looking more specifically at FIG. 1, it can be seen that a printer assembly 10 has been shown. The printer assembly 10 generally sits on a cabinet. For purposes of explanation, the cabinet has been removed from underneath the printer assembly. Suffice it to say, the printer assembly 10 generally has a control panel as well as an underlying base and fans for circulating air throughout the printer assembly to maintain a desirable operating temperature.

Looking more specifically at the printer assembly, it can be seen that the printer assembly incorporates a paper transport 12. In order to move the paper, a left oriented tractor 14 and a right oriented tractor 16 are shown. The respective tractors engage the paper in the openings thereof and move it along for progressive line printing. The tractors incorporate tractor locks 18 and 20. The tractors are supported on a tractor support shaft 22. The tractors are driven by a splined shaft 24 which is connected to a spline shaft pulley 26 which is in turn connected to the paper drive system within the shroud 28.

A knob 30 for adjusting the tractor is incorporated for movement thereof.

A form thickness lever 34 is shown having a scale thereon to allow for various thicknesses of forms as scaled with respect to reading from a forms thickness pointer 36.

In order to orient the paper correctly, a paper scale 38 is shown along the top of an air shroud assembly 40. The air shroud assembly 40 allows for overlayment of a significant portion of the mechanical movements. It is also in proximity to the hammerbank which will be described hereinafter for maintaining cooling thereof.

Two ribbon hubs 46 and 48 are provided, each with a hub locking latch 50 and 52. A ribbon 54 is shown wound around ribbon spools 56 and 58. These two respective ribbon spools 56 and 58 reciprocally wind and release the ribbon so that it can pass the hammers of the hammerbank as will be described hereinafter. Each ribbon spool 56 and 58 is driven by an underlying ribbon motor in the base of the printer namely base 60 which can be formed of a casting. The casting serves to provide steadiness and surety of indexing.

The ribbon 54 is guided by a ribbon guide 62 which is shown on the right side but is hidden from view on the left side. The left side ribbon guide mirrors the ribbon guide 62 shown on the right side of the drawing.

Figure 2:
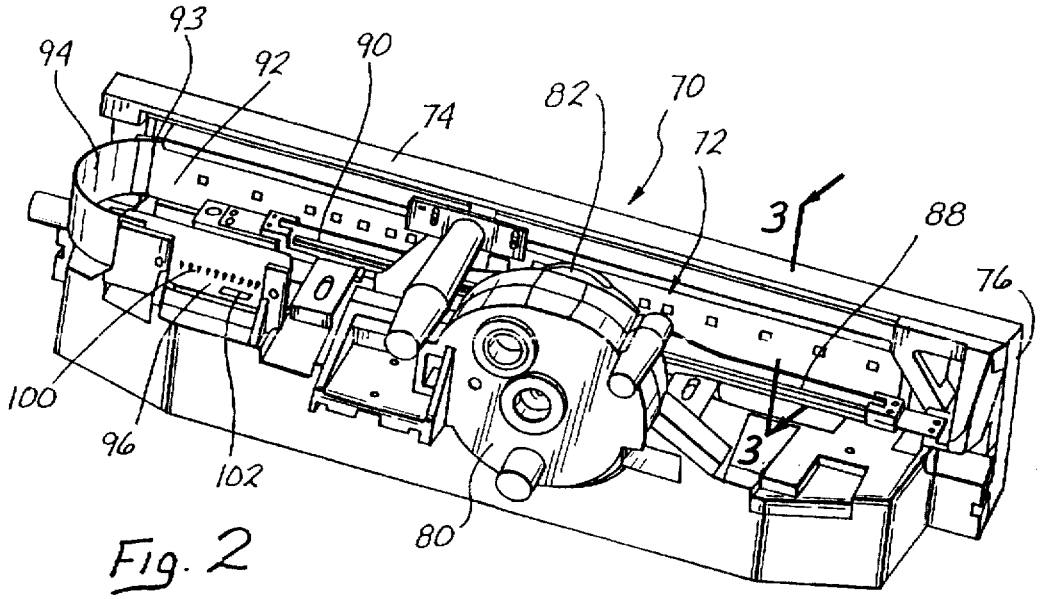
FIG. 2 shows a perspective view of the hammerbank with the base and a shuttle assembly for driving the hammerbank.

The foregoing description of FIG. 1 generally describes the mechanical and electromechanical aspects of the invention as to the general configuration and operation thereof. Looking more particularly at FIG. 2, it can be seen wherein a shuttle frame assembly 70 is shown. The shuttle frame assembly 70 includes a hammerbank assembly 72 which is shown covered in part as well as a counterweight assembly 74. The counterweight assembly 74 is supported on leaf springs at either end, one of which, namely leaf spring 76 is shown. The counterweight assembly 74 serves to balance the movement of the hammerbank assembly as it is driven.

A shuttle motor 80 is shown. The shuttle motor 80 has a number of teeth at its outer circumference 82. These teeth are used for electrical impulse timing purposes in order to time the operation of the entire printer based upon motor movement. In effect, the movement of the shuttle is timed with the respective firing of the hammers and the driver movement by the shuttle motor 80.

The hammerbank assembly 72 is driven by the motor 80 by means of two reciprocating drive rods 88 and 90.

On the back of the hammerbank assembly 72 is a circuit board 92 which is connected by cable connection 93 to a flexible cable 94 having a number of lines thereof which terminate at a terminator board 96. The terminator board 96 provides a number of pins 100 for power as well as pins 102 for providing logic to the circuit board 92.

Figure 3:
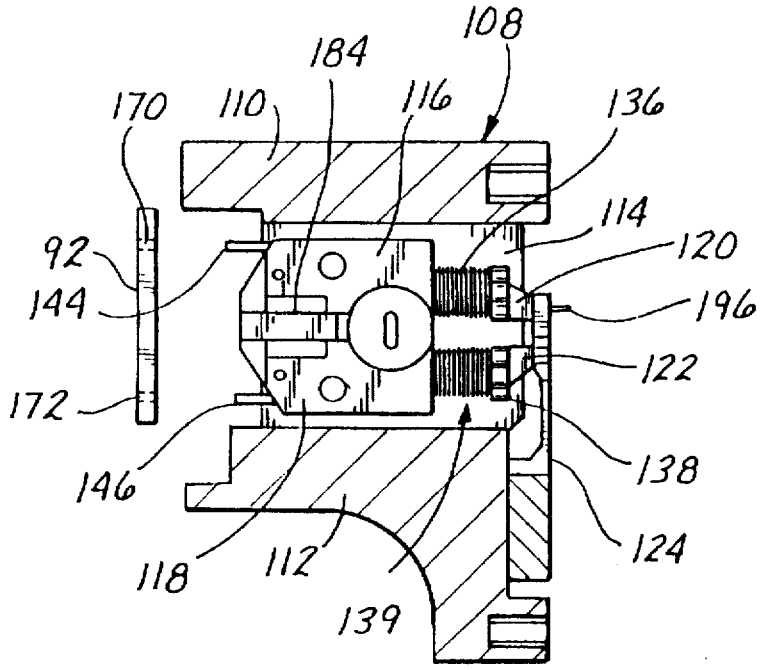
FIG. 3 shows a sectional view of the hammerbank along lines 3—3 of FIG. 2.
Figure 5:
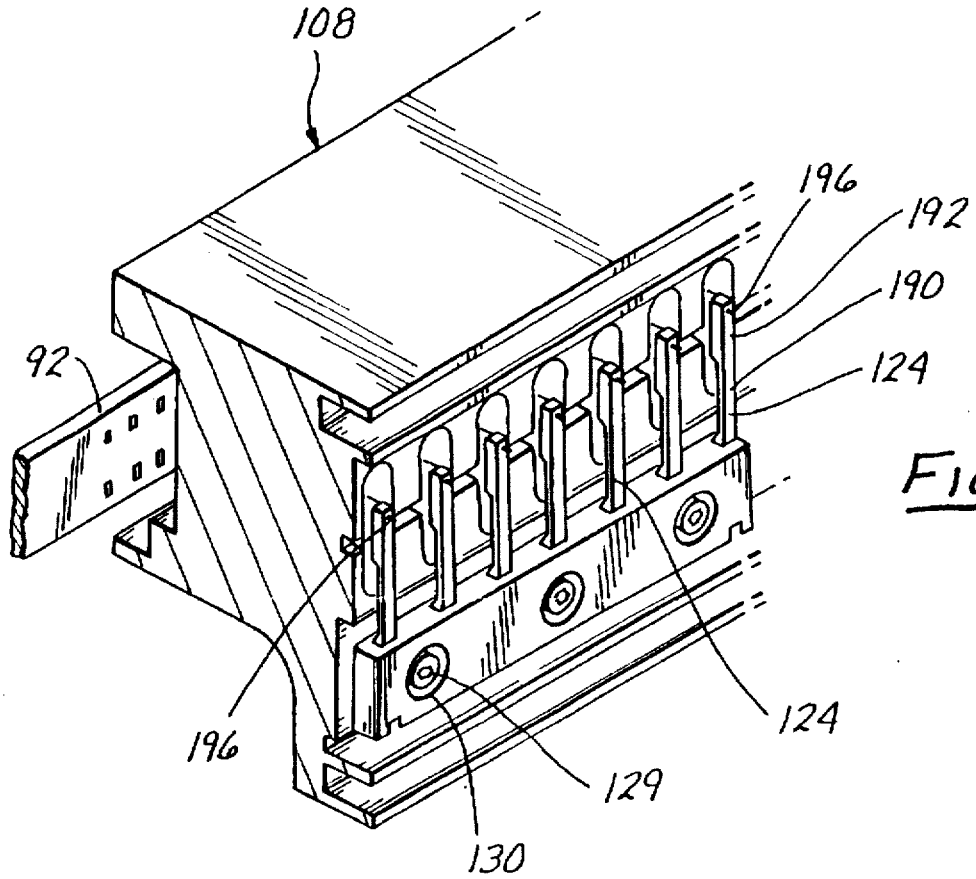
FIG. 5 shows a perspective view of the hammers and the hammerbank on a fragmented sectional basis as the hammers face the ribbon for impacting print media.

Looking more particularly at FIGS. 3 and 5, it can be seen that the hammerbank is shown in cross-section. FIG. 3 is sectioned along lines 3—3 of FIG. 2. The sectional view in FIG. 3 shows the hammerbank casting 108 formed from an upper portion 110 and a lower portion 112. The respective upper portions 110 and lower portions 112 have a number of through holes 114 passing therethrough. The through holes 114, receive a pair of pole pieces formed as an upper pole piece 116 and a lower pole piece 118. The two pole pieces 116 and 118 terminate at ends 120 and 122.

Figure 4:
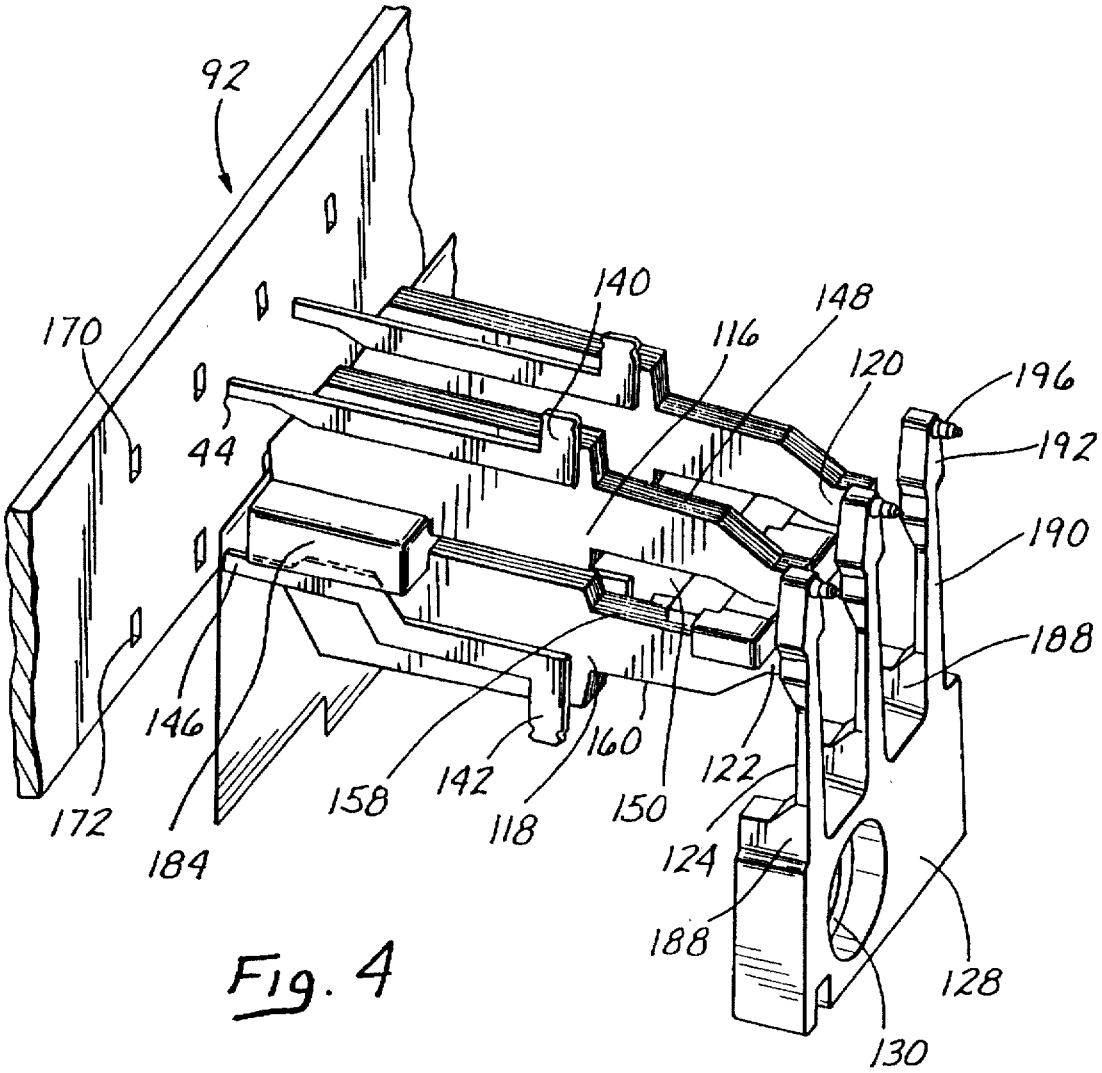
FIG. 4 shows a fragmented perspective broken away view of a portion of the hammers on the hammerbank, their pole pieces, and the integrated driver board.

Looking more particularly at FIG. 4, it can be seen that the upper pole piece 116 and the lower pole piece 118 have their ends 120 and 122 in contacting relationship with a series of hammers 124. The hammers are fundamentally formed as a series of hammers in frets of seven. Three of the hammers of one particular fret of seven is shown. The numbers of hammers in a fret 124 have been practically designed to accommodate groupings of three and eleven as well as seven.

The fret comprises a base portion 128 that can be secured with a screw 129 through a screw hole 130 to the hammerbank casting 112 as seen in FIG. 5.

Each of the pole pieces 116 and 118 have a coil 136 and 138 wrapped therearound comprising a continuous coil or winding 139. The coils 136 and 138 are fundamentally a continuing coil and are connected to terminals 140 and 142 which extend outwardly from the pole pieces forming circuit board connection terminals 144 and 146 and are shown in FIG. 3 as well as FIG. 4.

The portions of the pole pieces that are recessed in the form of ledges or insets 148 and 150 on pole piece 116 receive an upper coil as shown wound upon the pole piece in FIG. 3. The lower pole piece 118 has its coil wound upon the ledges or insets 158 and 160.

The connection terminals 144 and 146 are connected to a driver board in the form of the circuit board 92. The driver board in the form of the circuit board 92 has a plurality of openings which receive the connection terminals 144 and 146 therethrough. These openings can be seen as openings 170 and 172 respectively in FIGS. 3 and 4.

The pole pieces are generally potted or secured in any other manner in the cavities 114 within the upper and lower portions 110 and 112 of the hammerbank. Between each pole piece 116 and 118 is a permanent magnet 184. The permanent magnet 184 retains the hammers 124 of the hammerbank. Each hammer is shown having an enlarged base portion mounting 188 which extends upwardly and tapers into spring portion 190. Spring portion 190 terminates in an enlarged portion 192 which forms an enlarged head for purposes of receiving a pin or stylus 196 which provides the printing in the form of the dot matrix series.

When a voltage is applied to terminals 144 and 146, it energizes coils 136 and 138 in order to change the magnetic field and release the hammers 124 in order for the pin or stylus 196 to strike the ribbon which prints on the print media.

Figure 8:
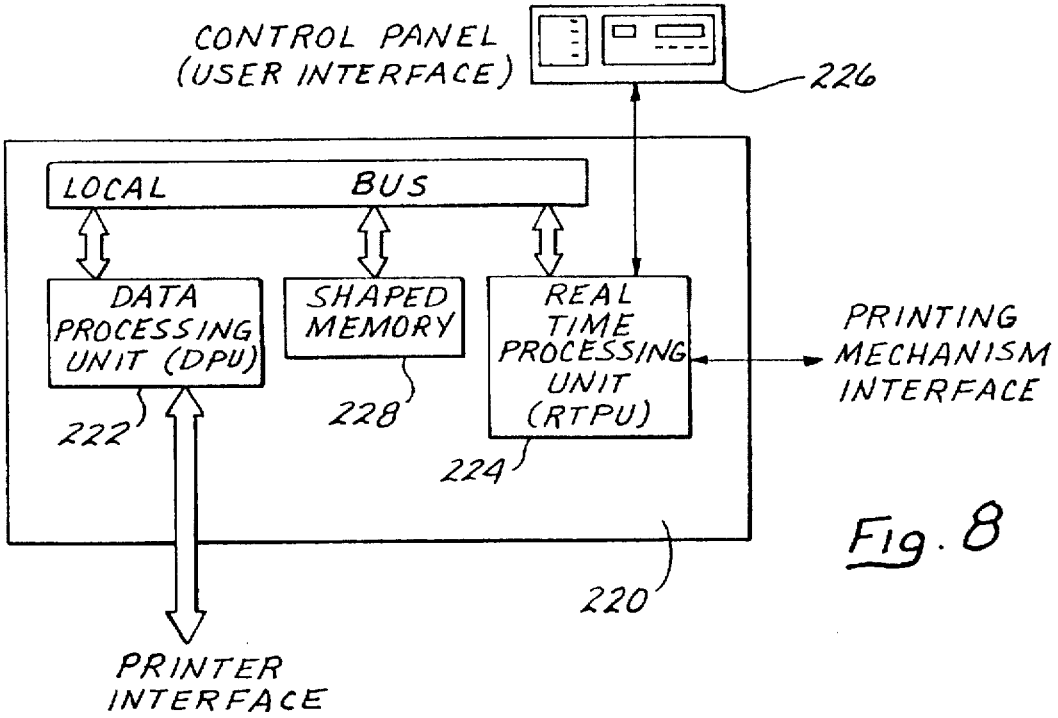
FIG. 8 shows a block diagram of the printer functions.
Figure 9:
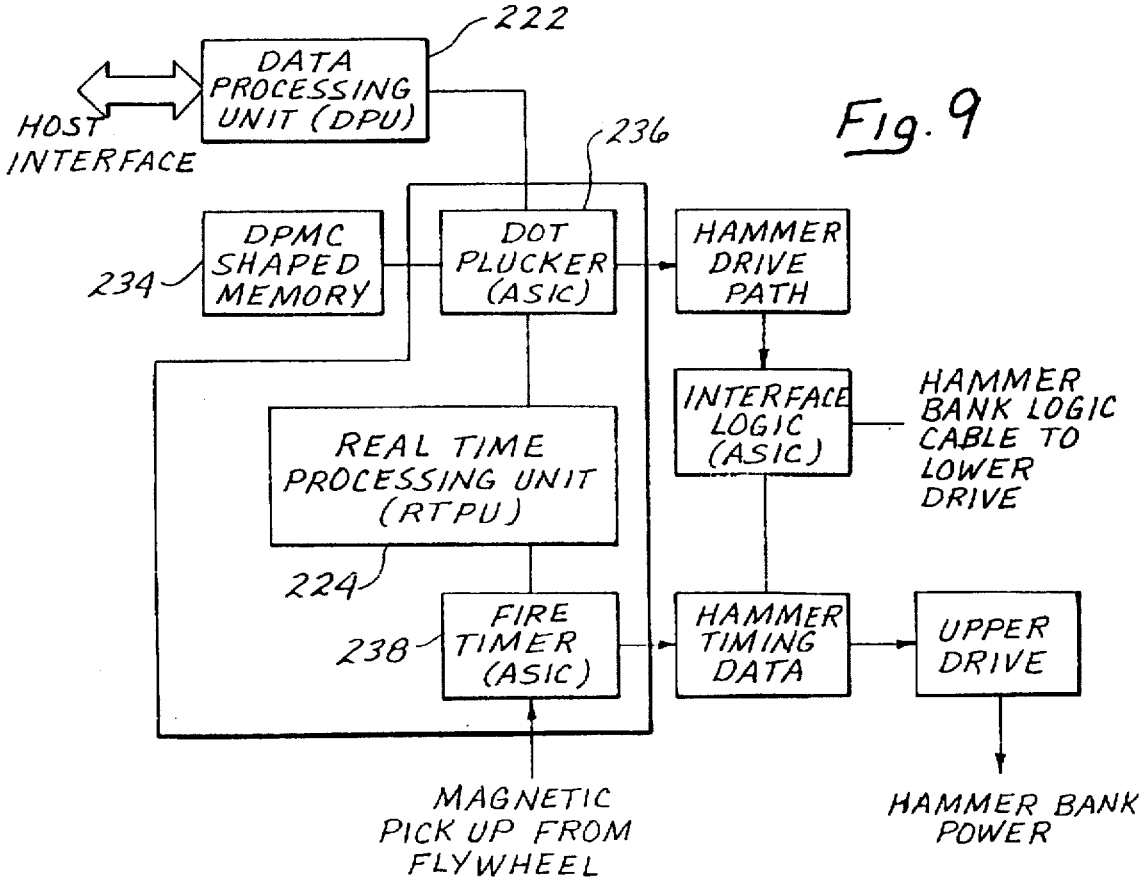
FIG. 9 shows a block diagram of the printer functions as related to the more discrete driving of the hammers of the hammerbank.

Looking at FIGS. 8 and 9, it can be seen wherein the operating system of the printer has been shown. The heart of the printer is a controller board 220. The controller board 220 has a functionality based upon two units, namely the data processing unit (DPU) 222 and the real time processing unit (RTPU) 224.

The DPU 222 converts all the character data into printable dot images. The DPU 222 is a high level logical controller of the printer and is not involved in real time or hardware dependent printer operation.

The RTPU 224 operates the printing mechanism interface. An operator control panel 226 is served by the DPU 222. The print mechanism which interiorly comprises the printer electromechanical portions previously described in FIGS. 1 through 5 is controlled by the RTPU 224. The RTPU 224 also monitors the fault circuitry in the entire printer.

The DPU 222 and RTPU 224 communicate by means of a shared memory 228. The DPU 222 interfaces directly with the host and operator input at the operator panel 226 from buffers in memory which are filled by the RTPU 224 and returns dot images and operator messages to buffers in memory which the RTPU 224 empties. The DPU 222 in effect communicates the need for some action, such as print media movement or printing to the RTPU 224 through shared memory.

The controller board 220 processes two kinds of computer input namely 1284 parallel and 232-E serial. The DPU 222 operates both interfaces. The DPU 222 uses direct memory access hardware to load parallel data directly into shared memory. Other interfaces can be added to the internal expansion bus.

The serial interface requires byte-by-byte intervention by the processor since ACK/NACK and XON/XOFF protocols require that every byte be examined as it is received. The universal synchronous receiver/transmitter is serviced by the DPU 222. The DPU 222 is responsible for all interface protocols. It must accept data from any port and process it according to the printer emulation running in the DPU 222 at that time.

The printer communicates with the operator by means of a display such as a liquid crystal display and light emitting diodes on the control panel 226. The operator communicates with the printer by pressing momentary contact switches or keys which are shown schematically on the control panel 226.

There are three kinds of control panel operations; keystroke input, display output, and indicator output. The DPU 222 handles the control panel interface requirements of shifting and clocking control panel data, but the DPU 222 processes the data.

The printer contains a flash memory that can be downloaded through the parallel printer interface. To program the flash memory, the printer is powered up with the control keys pressed. The DPU 222 goes into a down loading mode. The DPU 222 waits for a valid file to be sent through the parallel port then the DPU 222 erases its flash memory and writes the new program into flash memory. Flash memory is non-volatile, hence the program is permanent unless a new program is downloaded.

During the printing process, the RTPU 224 coordinates printing of the dot images sent from the DPU 222. Printing is fundamentally divided into two functional activities, namely hammer driver interface functions and mechanical interface functions.

In order to print a dot image, the dots firstly must be received by the hammers in order to have the hammers 124 release so that the pins 196 will impact the ribbon one dot row at a time and in the correct sequence. Secondly, the hammers 124 must fire at the appropriate time during the stroke of the shuttle. The stroke of the shuttle is derived from the motor 80 reciprocally moving the hammerbank 72 by the motor driving the drive rods 88 and 90.

The RTPU 224 controls both of these functions. However, each is actually performed by an application specific integrated circuit (ASIC) dedicated to the function. These ASICs comprise a dot plucker, memory controller, and a fire timer integrated circuit.

The hammer driver interface functions of the RTPU 224 can be seen in FIG. 9. FIG. 9 is fundamentally a block diagram of the hammer driver interface functions of the RTPU 224.

In order to provide a sequence of dots for the printing by the hammers, it is necessary to go into a shared memory 234. The shared memory 234 provides the bits in a given order and shifts them to the hammer driver at the correct time. Fundamentally, this is a process of plucking dots that are appropriate for the respective timing and placement of the hammerbank 70.

The order in which the dots are taken from the memory 234 depends upon the dot density, the number of dots per hammer, the number of hammers on the hammerbank, and the number of phases as well as other well known line printer control movement factors. These factors are all considered by the RTPU 224 as it programs the dot plucker and the fire timing functions.

The hammer fire control consists of synchronizing the firing of different sections of the hammerbank 72 with the position of the shuttle. The synchronization varies with the dot density, the number of dots per hammer, the number of hammers on the hammerbank, the number of phases and the other previously mentioned factors. In this manner, the fire timer functions form a synchronization of most factors programmed into the fire timing tables which are transferred by the RTPU 224 to the other portions of the system.

The ASIC's 238 fire timing function has the responsibility of tracking the magnetic pick-up pulses from the teeth on the motor 80 that indicate shuttle position that relates to timer hammer firing, which the magnetic pulses are indicative of. When the position of the hammerbank matches a position dictated by the fire table, the fire timer requests some action. The action may be a fire command or a paper advance to prepare for the next dot row. The requested action is sent to the hammer drive and interface function or the paper feed function of the ASIC 238. A fire command will cause one or more upper and lower drive groups or phases to start a dot fire cycle. The cycle consists of turning on and then off upper and lower driver phrases. The upper drivers shape the current profile that creates a dot. The lower drivers select which hammer will or will not participate in the fire event, creating or not creating a dot at that position on the paper.

The transfer of the dots to the hammer driver must be synchronized with hammer firing. The dots are transferred to the hammer driver in serial streams of dots or bursts, that tell which hammer must print when their phase is next fired. The fire cycle is long compared to the burst, but times between fire cycles are short. As soon as a phase has started a fire cycle, a new burst of dot data for that phase is requested. This allows the dot plucker some time to calculate and find the correct dot data. The actual fire time for a phase or set of dots is dictated by the fire tables. The fire timing function of the ASIC 238 synchronizes the fire table time to the position of the hammerbank and requests data bursts accordingly.

The mechanical operations are coordinated when printing, so that the print drive in the form of the tractors 16 and 18 can effectively advance the paper along by movement of the spline shaft 24 which is connected to the paper drive motor for moving the paper. Ribbon motion of the ribbon 54 by the motors connected to the spools 46 and 48 is controlled by the process as well as shuttle motion of the shuttle 70. Control of the paper, ribbon, platen and shuttle are performed by the RTPU, its ASICs, analog and power circuits contained on the controller board.

The DPU requests paper move commands and print commands as a response to host or operator requests. The RTPU 224 operates the media, platen, ribbon, and shuttle motors and hammer firing in response to paper motion or print commands. These functions are contained on the controller board except for a portion of the hammer drive mounted to the hammerbank.

In order to drive the hammers by causing them to be released by overcoming the permanent magnetism a number of transistors such as mosfet drivers are utilized on the board 92. These are seen more clearly in FIG. 6. In this particular showing, it can be seen that the board 92 has been fragmented to show only a portion of the mosfets, resistors and other circuitry. The circuitry is controlled by means of the controller board as previously related through the flex cable 94 directly to the hammerbank circuit board 92, flex cable connection 93.

Figure 10:
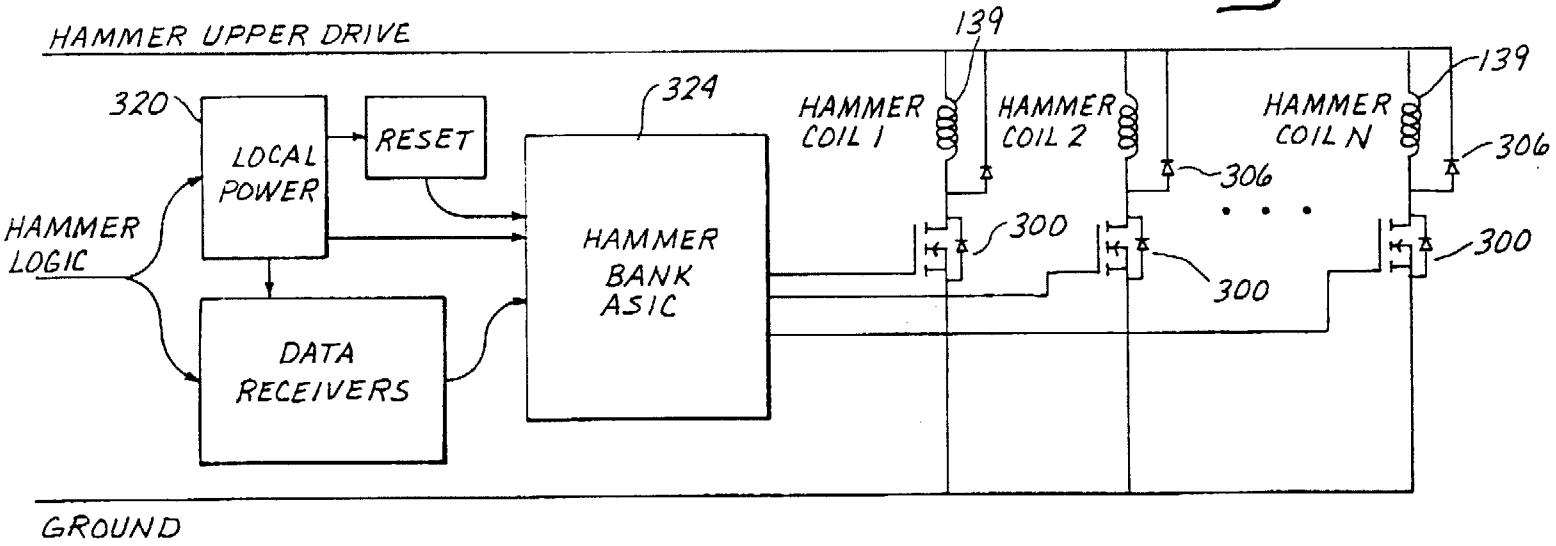
FIG. 10 shows a block diagram of the hammerbank board incorporating the components in part shown in FIG. 6.

Looking more specifically at FIG. 10, the board 92 is shown with some of the functions thereof in a block diagram. The feature showing the hammer logic to the local power, reset, data receivers, and hammerbank ASIC 324 are shown. The hammerbank coils comprising coils 139 which include coil portions 136 and 138 are also shown.

The block diagram of FIG. 10 further shows the mosfets 300 for each respective coil 139 and hammer. For purposes of simplicity, coils 1 through N have been shown as coils 1, 2 and coil N. Additionally, the flyback diodes 306 have been shown as well as the hammer upper drive and ground which has been previously described.

Figure 7:
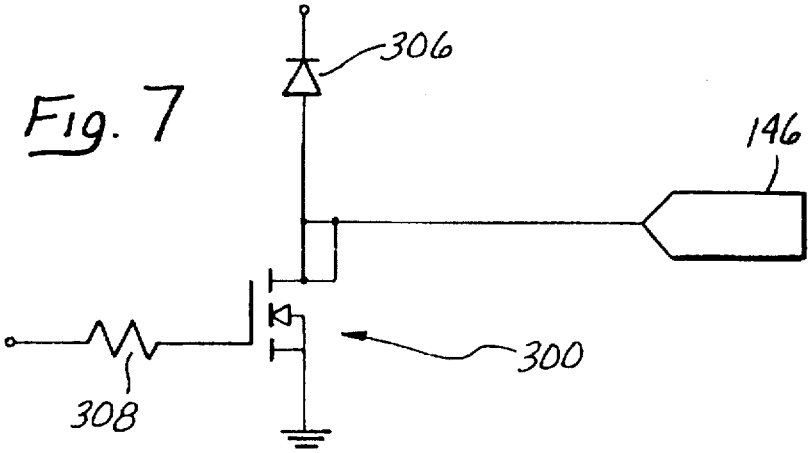
FIG. 7 shows a schematic view of the circuitry of one of the drivers of the coils which release the hammers of the hammerbank.

For purposes of placing a dot on the paper, the lower hammer drive mosfet of the respective hammer 124 at the desired dot position is energized. Energizing the lower mosfet connects the lower side of the coil to ground. At the same time, which is the proper phase fire time, the upper drive is connected through a mosfet to a 48 volt source. This completes a circuit that rapidly ramps the coil current to a level necessary to cancel the permanent magnetism. Too little, or too much current will either not cancel, or create a new opposite magnetic field, preventing the hammer 124 from flying away from the pole piece ends 120 and 122. At the time when the magnetism is canceled, the hammer 124 begins to fly toward the ribbon 54 and paper or media. The upper drive is switched from a 48V source to a 8.5V source. This voltage stops the rapid current rise and maintains a canceling effect on the magnetic field until such time as the hammer has impacted the ribbon and paper forming a dot image. At the time that the dot is formed, the lower drive is de-energized and the energy stored in the coil is returned to the upper drive through the flyback diode 306 seen in FIGS. 6, 7 and 10. The magnetic field is restored and the hammer 124 is drawn back to the pole pieces 120 and 122.

A lower drive mosfet 300, flyback diode 306, and gate resistor 308 are required for each hammer coil comprising coil sections 136 and 138. As more hammers 124 are added more hammerbank ASICs 324 are added. The ASICs inputs are tied together. Each ASIC is configured by its position on the board 92. It will use only the portion of the data stream corresponding to its hammers 124. The upper driver circuit is common to a group of hammers or logic phase. The upper drivers reside on the controller board and are connected to the upper side of the hammer coil through a few large conductors.

Figure 6:
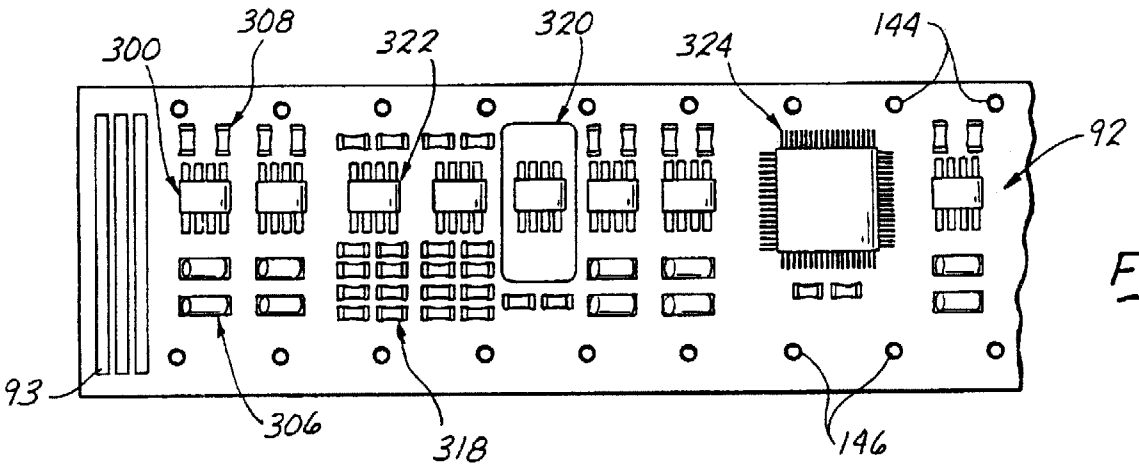
FIG. 6 shows a fragmented plan view of the driver board of this invention incorporating a portion of the components which are mounted on the hammerbank.

Looking more particularly at FIG. 6, it can be seen that this lower coil drive circuit is shown with individual mosfets 300 serving terminals 146. The series resistors 308 are shown blocked out as series resistors 308 in their respective block. The flyback diodes are each shown respectively as flyback diodes 306 in a block. The hammer coil portion 138 is shown connected at terminal 146 which is shown passing through the circuit board 92.

Protection of the circuit 92 is enhanced by an ESD protection circuit 318. Power on the circuit board for the 5 volt power of the mosfets is supplied by a small power supply 320. A local reset generator forces the hammerbank ASIC into a reset state after local power has been applied. Differential receivers 322 condition the data transmissions from the controller board to logic signals the hammerbank ASIC uses to fire the hammers 124. Finally, in order to help control the drivers in the form of the mosfets, a hammerbank ASIC with its terminals exposed namely driver 324 is shown.

The foregoing generally comprises the apparatus and process of the invention.

Based upon the elimination of the long cables and providing the drivers in the foregoing circuit from the apparatus of the printer, the resistance in the interconnect system has been reduced from a range of 1.7 to 2.3 ohms per hammer connection, to a single shared connection of 0.02 ohms. This reduces power loss in the system and allows for more timely and uniform control of each of the hammer's current and dot placement. Obviously, the less impedance through less ohms, the more sensitive the printer drivers are resulting in an improved printing process.

As an alternative embodiment to enhance the integrated hammer drive on the hammerbank, it need not be limited to a dual voltage overdrive with the upper drivers remote from the hammerbank board.

As one alternative the overdrive devices off the board 92 could be eliminated for a slower less costly printer.

A second alternative would be to have individual small geometry overdrive devices for each hammer all mounted on the hammerbank board. This configuration would allow more flexibility in drive timing and provide higher resolution dot placement.

It can be readily seen that this invention is a step over the prior art in providing improved printing with the orientation of the hammer drivers, the combination of elements and the overall electromechanical printer functions of the invention which should be read broadly in light of the following claims.

We claim:

1. A printer having a reciprocally moving hammerbank with a plurality of hammers thereon comprising:

magnetic means on said hammerbank for retention of said hammers on the hammerbank from firing;

coil means on said hammerbank for overcoming the magnetism of said magnetic means; and, circuit means connected to said coil means for providing power to said coil means comprising transistor means mounted on the hammerbank for providing at least a portion of the power to said coil means, and at least one logic control circuit mounted on the hammerbank connected to said transistor means.

2. The printer as claimed in claim 1 further comprising:

an elongated magnetic means for retention of a plurality of said hammers; and, circuit board means mounted on the hammerbank with said transistor means.

3. The printer as claimed in claim 1 further comprising:

a second transistor means connected to said coil means having a voltage greater than the first transistor means.

4. The printer as claimed in claim 1 further comprising:

a data processing unit and a real time processing unit with a shared memory; and, a dot plucking circuit interconnected to said real time processing unit for plucking dots to be respectively printed by the hammers of said hammerbank.

5. The printer as claimed in claim 4 further comprising:

an interface logic circuit connected to said dot plucking circuit and to said transistor means.

6. The printer as claimed in claim 5 further comprising:

said data processing unit connected to a host interface and to said dot plucking circuit.

7. A line printer comprising:

a print media drive;

a hammerbank having a plurality of hammers thereon with pins for printing dots;

a ribbon drive including a ribbon for moving ribbon between the pins of said hammers and said print media;

motor means for causing said hammerbank to move reciprocally;

permanent magnetic means for retention of said hammers;

a pair of pole pieces contacting said hammers in a magnetic circuit provided by said permanent magnetic means;

coil means wrapped around at least a portion of said pole pieces, wherein said coil means terminates in two terminals;

circuit means mounted on said hammerbank connected to said coil means terminals for reversing the plurality of said pole pieces having transistor means mounted on the hammerbank for providing voltage to said coil means; and, a logic circuit mounted on said hammerbank connected to said transistor means to control the transistors in part.

8. The printer as claimed in claim 7 further comprising:

resistor means and power supply means for said transistor means mounted on said hammerbank in connected relationship to said transistor means on said hammerbank.

9. The printer as claimed in claim 7 further comprising:

a circuit board mounted on said hammerbank connected to said terminals of said coils and on which said transistor, means and logic circuit are mounted directly thereon.

10. The printer as claimed in claim 9 further comprising:

a real time processing unit interconnected to a data processing unit which interfaces with a host computer.

11. A line matrix printer comprising:

a hammerbank having a plurality of hammers thereon;

means for reciprocally moving said hammerbank;

means for moving print media across said hammerbank;

means for interposing a print ribbon between said hammerbank and said print media;

permanent magnetic retention means mounted directly on said hammerbank for retention of hammers on said hammerbank;

a coil mounted directly on said hammerbank in associated relationship with each hammer of said hammerbank which reverses polarity of said permanent magnetic retention means to release said hammers;

transistor drive means mounted on said hammerbank for driving the coils with a respective voltage to reverse at least in part the magnetic retention of said permanent magnet retention means; and, a logic circuit mounted on said hammerbank in connected relationship to said transistor drive means.

12. The printer as claimed in claim 11 further comprising:

a circuit board mounted on said hammerbank with said transistor drive means; and, at least one resistance means and a flyback diode associated with each of said transistor drive means on said circuit board.

13. A method for firing hammers on a hammerbank of a line matrix printer with a plurality of hammers thereon comprising:

providing magnetic means on said hammerbank for retaining said hammers on the hammerbank from firing:

providing coil means on said hammerbank for overcoming the magnetism of said magnetic means;

providing circuit means connected to said coil means for providing power to said coil means;

driving said circuit means at least in part by transistors on said hammerbank to provide power to said coil means to fire said hammers on said hammerbank; and, controlling said transistors by a logic circuit mounted on said hammerbank.

14. A printer having a reciprocally moving hammerbank with a plurality of hammers thereon comprising:

magnetic means on said hammerbank for retention of said hammers before firing;

coil means on said hammerbank for overcoming the magnetics of said magnetic means;

circuit means connected to said coil means for providing power to said coil means comprising transistor means located on the hammerbank of the printer for providing power to said coil means; and, a power supply mounted on the hammerbank connected to said transistor means.

15. The printer as claimed in claim 14 further comprising:

an elongated magnetic means for retention of a plurality of said hammers; and, circuit board means mounted on the hammerbank with said transistor means for providing at least a portion of the power to said coil means.

16. The printer as claimed in claim 14 further comprising:

a second transistor means connected to said coil means having a voltage greater than the first transistor means.

17. The printer as claimed in claim 14 further comprising:

a data processing unit and a real time processing unit with a shared memory; and, a dot plucking circuit interconnected to said real time processing unit for plucking dots to be respectively printed by the hammers of said hammerbank.

18. The printer as claimed in claim 17 further comprising:

an interface logic circuit connected to said dot plucking circuit and to the first transistor means.

19. The printer as claimed in claim 17 further comprising:

said data processing unit connected to a host interface and to said dot plucking circuit.

20. A method for firing hammers on a hammerbank of a line matrix printer with a plurality of hammers thereon comprising:

providing magnetic means on said hammerbank for retaining said hammers on the hammerbank from firing:

providing coil means on said hammerbank for overcoming the magnetism of said magnetic means;

providing circuit means connected to said coil means for providing power to said coil means;

driving said circuit means at least in part by transistors on said hammerbank to provide power to said coil means to fire said hammers on said hammerbank; and, providing a power supply mounted on said hammerbank.

21. The method as claimed in claim 20 further comprising:

providing a logic circuit for said transistors mounted on said hammerbank.

* * * * *